US008865253B2

(12) United States Patent
Muramatsu et al.

(10) Patent No.: US 8,865,253 B2
(45) Date of Patent: Oct. 21, 2014

(54) METHOD OF COLORING SURFACE OF ZIRCONIUM-BASED METALLIC GLASS COMPONENT

(75) Inventors: Naokuni Muramatsu, Nagoya (JP); Ken Suzuki, Handa (JP); Akihisa Inoue, Sendai (JP); Hisamichi Kimura, Watari-Gun (JP)

(73) Assignees: NGK Insulators, Ltd., Nagoya (JP); Tohoku University, Sendai (JP)

( * ) Notice: Subject to any disclaimer, the term of this patent is extended or adjusted under 35 U.S.C. 154(b) by 642 days.

(21) Appl. No.: 13/009,082

(22) Filed: Jan. 19, 2011

(65) Prior Publication Data

US 2011/0107795 A1 May 12, 2011

Related U.S. Application Data

(62) Division of application No. 11/597,942, filed as application No. PCT/JP2005/009800 on May 27, 2005, now Pat. No. 7,923,067.

(30) Foreign Application Priority Data

May 28, 2004 (JP) ..... 2004-160231

(51) Int. Cl.
*C25D 11/26* (2006.01)

(52) U.S. Cl.
CPC ..... *C25D 11/26* (2013.01)
USPC ..... 427/215

(58) Field of Classification Search
USPC ..... 427/215, 216
See application file for complete search history.

(56) References Cited

U.S. PATENT DOCUMENTS

| | | | | |
|---|---|---|---|---|
| 3,767,541 | A | 10/1973 | Curtis | |
| 4,994,314 | A | 2/1991 | Rosenfeld et al. | |
| 6,346,174 | B1 | 2/2002 | Finley et al. | |
| 6,666,983 | B2 * | 12/2003 | Marietti et al. | 216/75 |
| 2003/0075079 | A1 * | 4/2003 | Sommer | 106/442 |

FOREIGN PATENT DOCUMENTS

| | | | |
|---|---|---|---|
| JP | 01-123042 | A1 | 5/1989 |
| JP | 03-130397 | A1 | 6/1991 |
| JP | 04-013894 | A1 | 1/1992 |
| JP | 05-179484 | A1 | 7/1993 |
| JP | 06-045915 | | 6/1994 |
| JP | 03-166044 | * | 11/2001 |
| JP | 2003-166044 | A1 | 6/2003 |
| KR | 2000-0076300 | | 12/2000 |
| WO | 98/40541 | | 9/1998 |

OTHER PUBLICATIONS

Machine Translation of JP 2003-166044 (Nov. 2001).*
Habazaki et al., "*Anodic Film Formation on Sputter Deposited Amorphous Al-Zr Alloys*," J. Phys. D: Appl. Phys. 28, pp. 2612-2618 (1995).
Korean Office Action from a corresponding Korean patent application bearing a mailing date of Dec. 22, 2011, pp. 1-4.

* cited by examiner

*Primary Examiner* — Robert Vetere
(74) *Attorney, Agent, or Firm* — Burr & Brown, PLLC

(57) ABSTRACT

A method of coloring a surface of a zirconium-based metallic glass component that includes the step of imparting interference colors by carrying out an anodizing process using an alkaline solution to form a film having a thickness of 300 nm or less on the surface of the zirconium-based metallic glass component.

1 Claim, 2 Drawing Sheets

METHOD OF COLORING SURFACE OF ZIRCONIUM-BASED METALLIC GLASS COMPONENT

CROSS REFERENCE TO RELATED APPLICATION

This application is a division of U.S. patent application Ser. No. 11/597,942, now U.S. Pat. No. 7,923,067 filed Nov. 28, 2006, which was the National Stage of International Application No. PCT/JP2005/009800 filed May 27, 2005, and claims the benefit under 35 USC §119(a)-(d) from Japanese Patent Application No. 2004-160231 filed May 28, 2004, the entireties of which are incorporation herein by reference.

FIELD OF THE INVENTION

The present invention relates to a method of coloring a surface of a zirconium-based metallic glass component for the purpose of even coloring without causing crystallization on the surface of the zirconium-based metallic glass component.

BACKGROUND OF THE INVENTION

Metallic liquid normally enters an extremely unstable state when cooled below a melting point, and is immediately crystallized to become crystallized metal. In this event, time for which a supercooled liquid can exist in an uncrystallized state where atoms are randomly arranged, i.e., a so-called "amorphous state," is estimated to be 10-5 seconds or less at a nose temperature of a continuous cooling transformation (CCT) curve. Specifically, this means that it is impossible to obtain amorphous alloys unless a cooling rate of 106 K/s or more is achieved.

However, there has recently been invented metallic glass which undergoes clear glass transition and is not crystallized even at a cooling rate of 100 K/s or less since a supercooled liquid state is extremely stabilized in a specific alloy group including a zirconium base (see, for example, The June 2002 edition of Kinou Zairyou (Functional Materials), Vol. 22, No. 6, p. p. 5-9; Non-Patent Document 1).

Since the metallic glass has a wide supercooled liquid temperature range, superplastic forming utilizing a viscous flow is possible while under conditions that do not reach a temperature and time at which the glass is transformed into crystals again. Thus, the metallic glass is expected to be put into practical use as a structural material.

Among the metallic glass, as in the case of commercial titanium used as a structural material, zirconium-based metallic glass containing zirconium as a basic component, having a high affinity for oxygen has been expected to have its surface colored in several colors depending on its thickness by forming an oxide film on the surface.

For example, Japanese Patent Publication No. 2003-166044 (Patent Document 1) discloses a method of toning a surface of zirconium-based amorphous alloy in brown with a thickness of 0.1 μm or less, in black with a thickness of 0.1 to 8 μm and in gray with a thickness of 8 μm or more by subjecting the zirconium-based amorphous alloy to heat treatment in the atmosphere. The method proposed here is basically a method by which surface oxidation by heating at 350° C. to 450° C. in the atmosphere is expected.

However, in the method described in Patent Document 1, it is impossible to manage an oxide film in order that the entire zirconium-based metallic glass component can be evenly colored. Moreover, the type of color obtained is limited to brown, black or gray. Thus, the method has a problem that a decorative surface desired for the zirconium-based metallic glass component is extremely limited.

Furthermore, in the method described in Patent Document 1, heating and oxidation in the atmosphere tend to accelerate crystallization of a normally amorphous surface layer more than desired. Thus, the method also has a problem that the zirconium-based metallic glass component becomes fragile unless an amorphous structure of the surface layer of the entire zirconium-based metallic glass component is maintained and controlled by strictly managing both the temperature and time.

Consequently, in order to solve the problems described above, the inventors of the present invention have carried out numerous studies for the purpose of coloring the surface of the zirconium-based metallic glass component. As a result, the inventors have found out that it is possible to perform coloring in many colors without worrying about crystallization depending on the temperature by carrying out an anodizing process to form an interference film. Moreover, the inventors have also found out that it is possible to produce many colors without causing crystallization by heating while controlling an inert gas atmosphere. Furthermore, the present invention has been accomplished by optimizing conditions for formation of the film.

SUMMARY OF THE INVENTION

The present invention has been made in consideration of the foregoing problems. It is an object of the present invention to provide a method of coloring a surface of a zirconium-based metallic glass component, the method also makes it possible to realize a wide variety of colors to be produced on the surface of the zirconium-based metallic glass component (a component to be formed) without causing crystallization on the surface.

A first aspect of the present invention provides a method of coloring a surface of a zirconium-based metallic glass component that includes the step of imparting interference colors by carrying out an anodizing process using an alkaline solution to form a film having a thickness of 300 nm or less on the surface of the zirconium-based metallic glass component.

According to the first aspect of the present invention, the alkaline solution may be a potassium hydroxide solution.

Moreover, the first aspect of the present invention provides a method of coloring a surface of a zirconium-based metallic glass component including the step of imparting interference colors by forming a film having a thickness of 300 nm or less on the surface of the zirconium-based metallic glass component by heating the zirconium-based metallic glass component at a temperature equal to or lower than a crystallization temperature of zirconium-based metallic glass in an inert gas atmosphere having an oxygen concentration of 500 ppm or less.

DETAILED DESCRIPTION OF THE INVENTION

With reference to the drawings, a detailed description will be given below of the method of coloring a surface of a zirconium-based metallic glass component according to the cases of both the first and second embodiments of the present invention.

First Embodiment of the Present Invention

Figure 1:
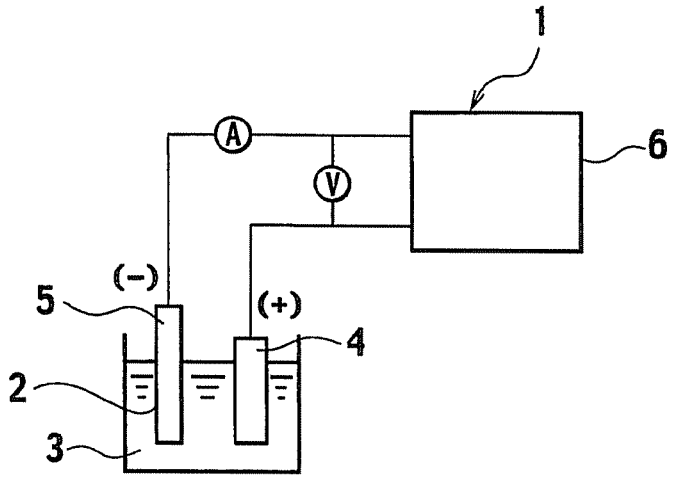
FIG. 1 is a schematic diagram of an electrolytic apparatus applied to a method of coloring a surface of a zirconium-based metallic glass component according to a first embodiment of the present invention.

FIG. 1 is a diagram showing an electrolytic apparatus 1 applied to the method of coloring a surface of a zirconium-based metallic glass component according to the first embodiment of the present invention.

The method of coloring a surface of a zirconium-based metallic glass component according to the first embodiment of the present invention includes the step of imparting interference colors by carrying out an anodizing process using an alkaline solution to form a film having a thickness of 300 nm or less on the surface of the zirconium-based metallic glass component.

As shown in FIG. 1, a bath 2 for the surface treatment in the electrolytic apparatus 1 is filled with an alkaline solution 3 which is to be used as an electrolytic solution. Moreover, the electrolytic apparatus 1 is configured to use a zirconium-based metallic glass component 4 as an anode and to use a passive metal 5 such as aluminum and/or titanium, for example, as a cathode. Furthermore, the electrolytic apparatus 1 is configured to apply a voltage by electrically connecting the anode and the cathode to a direct-current power supply 6.

In this embodiment, as the alkaline solution 3, a potassium hydroxide (KOH) solution is used, which realizes relatively easy selection and control of the processing conditions for the current, voltage and conduction time. Note, however, that the present invention is not necessarily limited to the above described case but is also applicable to the case of using, as the alkaline solution 3, a sodium hydroxide solution, a calcium hydroxide solution, a barium hydroxide solution, a sodium carbonate solution, an ammonium carbonate solution, a sodium phosphate solution or the like.

Note that, in the present invention, the alkaline solution is selected as the electrolytic solution since the zirconium-based metallic glass component is not colored as a result of using various neutral solutions or acid solutions as the electrolytic solution is used in the anodizing process.

To be more specific, about 0.5% to 10% of the potassium hydroxide (KOH) solution is preferable since the solution makes it relatively easy to control the processing conditions described above while selecting the conditions.

Specifically, by applying a voltage of 5V to 20V to allow a direct current of 1 A to 5 A to flow for about 3 to 30 minutes, as time passes, an interference film is formed on the surface of the zirconium-based metallic glass component 4.

Furthermore, the above-described processing conditions (electrochemical conditions) may be selected for each of interference colors of the film, including yellow, green, blue, purple, gold and the like.

Note that the present invention is not necessarily limited to the processing conditions described above but may be applied to processing within a short amount of time by allowing a larger current to flow under a larger voltage. It suffices to select the processing conditions depending on the size of the zirconium-based metallic glass component or processing efficiency desired.

Second Embodiment of the Present Invention

Figure 2:
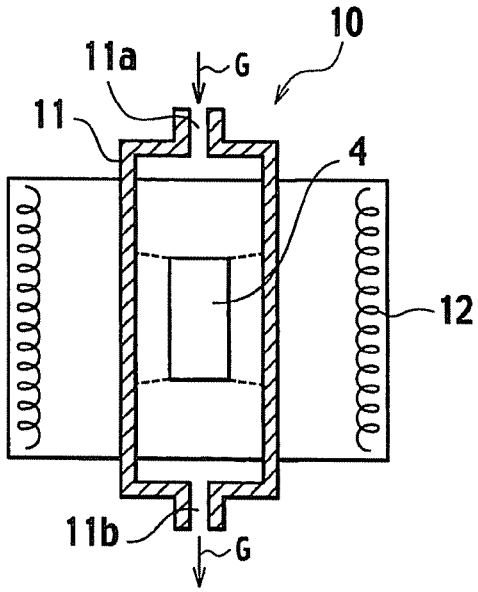
FIG. 2 is a schematic diagram of a heating apparatus applied to a method of coloring a surface of a zirconium-based metallic glass component according to a second embodiment of the present invention.

FIG. 2 is a diagram showing a heating apparatus 10 applied to a method of coloring a surface of a zirconium-based metallic glass component according to a second embodiment of the present invention.

The method of coloring a surface of a zirconium-based metallic glass component according to this embodiment includes the step of imparting interference colors by heating the zirconium-based metallic glass component at a temperature equal to or lower than a crystallization temperature of zirconium-based metallic glass in an inert gas atmosphere having an oxygen concentration of 500 ppm or less while forming a film having a thickness of 300 nm or less on the surface of the zirconium-based metallic glass component.

As shown in FIG. 2, the heating apparatus 10 includes: a tubular vessel 11 having an inlet 11*a* and an outlet 11*b* for inert gas G; and a heater 12 provided around the tubular vessel 11.

In the heating apparatus 10, a zirconium-based metallic glass component 4 is placed in a stationary state inside the tubular vessel 11. Moreover, the heating apparatus 10 can form an interference film on the surface of the zirconium-based metallic glass component 4 by heating the zirconium-based metallic glass component at the crystallization temperature of zirconium-based metallic glass or less in the atmosphere of the inert gas G containing oxygen of 500 ppm or less.

Here, in a case where a heating temperature is selected in combination with processing time that is equal to or higher than the crystallization temperature of zirconium-based metallic glass (metallic glass to be processed), the zirconium-based metallic glass component 4 is immediately crystallized and therefore becomes fragile. Thus, the heating temperature is required to be set equal to or lower than the crystallization temperature of zirconium-based metallic glass.

For example, in this embodiment, in a case where Zr—Cu—Al—Ni metallic glass is used, a crystallization temperature of the metallic glass should be around 480° C. although there may be changes depending on a history. Thus, heating is preferably performed at 450° C. or less.

Here, it is not particularly required to set a lower limit of a heating temperature. However, in consideration of industrial processing efficiency, 300° C. or more is preferable. Note that, at the temperature of 300° C. or less, the film formation does not proceed at an observable rate.

Moreover, in this embodiment, the reason why the concentration of oxygen in the heating atmosphere is set at 500 ppm or less is because the concentration is suitable for producing colors while also controlling many interference colors. Note that, with an oxygen concentration of 500 ppm or more, the atmosphere approaches the case where heating is typically performed in the normal atmosphere. Thus, only very limited interference colors can be obtained.

Moreover, as the inert gas, it is possible to appropriately use argon (Ar) gas, nitrogen gas, helium gas and the like.

Furthermore, in the first and second embodiments described above, the reason why the thickness of the film is set at 300 nm or less is because the interference film on the surface, which is considered to be mainly made of oxide that is a constituent element of the metallic glass, is less likely to be peeled off.

Figure 3:
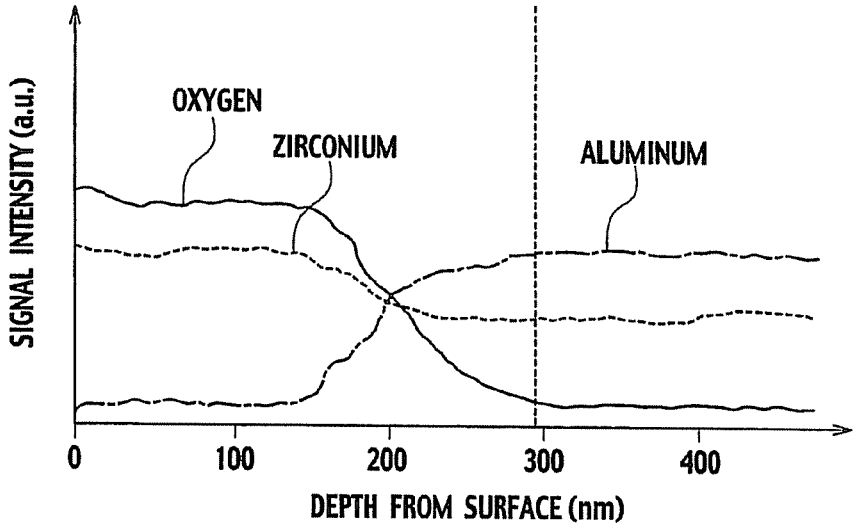
FIG. 3 is a graph showing results of an analysis on an interference film, which is formed on the surface of the zirconium-based metallic glass component, in a depth direction by XPS (X-ray photoelectron spectroscopy).

FIG. 3 shows results of confirming, by XPS (X-ray photoelectron spectroscopy), the presence of oxygen in a depth direction in the interference films respectively formed by use of the methods of coloring a surface of a zirconium-based metallic glass component in the cases of the first and second embodiments described above.

a cathode, inside the bath 2 filled with 2000 cc of the electrolytic solution. Moreover, the anode and the cathode were electrically connected to the direct-current power supply 6 to distribute power for an appropriate time. Table 1 shows processing conditions including "type of electrolytic solution," "solution property," "current value," "voltage value" and "conduction time," all of which were used here.

TABLE 1

| | Electrolytic solution | Solution property | Current (A) | Voltage (V) | Conduction time (minute) | Film color | Color evenness | Film thickness (nm) |
|---|---|---|---|---|---|---|---|---|
| Example 1 | 3% KOH | Alkaline | 3 | 10 | 15 | Green | ○ | 160 |
| Example 2 | 3% KOH | Alkaline | 3.5 | 9 | 20 | Blue | ○ | 190 |
| Example 3 | 3% KOH | Alkaline | 15 | 18 | 5 | Yellow | ○ | 140 |
| Example 4 | 5% KOH | Alkaline | 20 | 35 | 2 | Blue | ○ | 280 |
| Example 5 | 3% NaOH | Alkaline | 20 | 23 | 3 | Gray | ○ | 120 |
| Example 6 | 2% KOH | Alkaline | 3 | 18 | 30 | Light brown | ○ | 180 |
| Example 7 | 2% KOH | Alkaline | 20 | 35 | 25 | Black | ○ | 200 |
| Comparative Example 1 | 5% phosphoric acid | Acidic | 3 | 15 | 3 | Not colored | — | — |
| Comparative Example 2 | 5% phosphoric acid | Acidic | 5 | 10 | 30 | Not colored | — | — |
| Comparative Example 3 | phosphate solution | Neutral | 3 | 95 | 10 | Not colored | — | — |
| Comparative Example 4 | phosphate solution | Neutral | 1.5 | 30 | 7 | Not colored | — | — |

A close structural analysis on the interference films formed by use of the methods of coloring a surface of a zirconium-based metallic glass component in the cases of the first and second embodiments described above has not yet been fully completed. However, it has been proven that the interference films are naturally formed to have a thickness within a range not exceeding 300 nm.

Note that, in a case where the interference film is formed to have a thickness of over 300 nm, the surface layer is covered with a film in a zirconia state and becomes fragile. Accordingly, this results in peeling off of the interference film and a structure that is easily destroyed.

Figure 4:
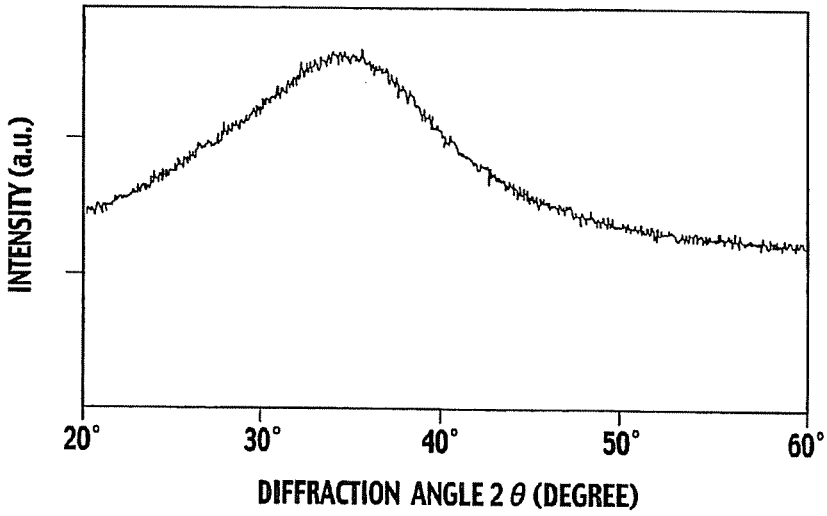
FIG. 4 is a graph showing a structure of a surface layer of the zirconium-based metallic glass component by X-ray diffraction.

FIG. 4 shows the structure of the surface layers of the zirconium-based metallic glass components respectively formed by use of the methods of coloring a surface of a zirconium-based metallic glass component in the cases of the first and second embodiments described above (results of observation by X-ray diffraction).

As shown in FIG. 4, a gently angular curve graph is obtained. Moreover, it is possible to confirm that the zirconium-based metallic glass component in the cases of the first and second embodiments described above is maintained to be amorphous.

Table 1 shows observation results and measurement results on interference films on zirconium-based metallic glass components 4 in the cases of Examples 1 to 7 and Comparative Examples 1 to 4.

The interference films on the zirconium-based metallic glass components 4 were formed by use of the method of coloring a surface of a zirconium-based metallic glass component according to the first embodiment described above.

The interference films on the zirconium-based metallic glass components 4 were formed in the following manner. Specifically, in the electrolytic apparatus 1 shown in FIG. 1, a zirconium-based metallic glass component 4 having a length of 20 mm, a width of 20 mm and a thickness of 0.5 mm was used as an anode, and a titanium plate 5 having a length of 100 mm, a width of 20 mm and a thickness of 1 mm was used as As shown in Table 1, the solution property of the electrolytic solution was "alkaline" in Examples 1 to 7, was "acidic" in Comparative Examples 1 and 2, and was "neutral" in Comparative Examples 3 and 4.

Moreover, Table 1 also shows "film color," "color evenness" and "film thickness," which are observation results and measurement results on the zirconium-based metallic glass components 4 obtained under the respective processing conditions (electrochemical conditions).

"Film color" and "color evenness" are the observation results obtained with the naked eye, and "film thickness" is the measurement result obtained by XPS (X-ray photoelectron spectroscopy). Note that, in Table 1, "O" means "even" under "color evenness."

Furthermore, in the method of coloring a surface of a zirconium-based metallic glass component according to the first embodiment, no heating is performed. Thus, it is assumed as a matter of course that the zirconium-based metallic glass component 4 is maintained to be amorphous. Therefore, confirmation was performed by X-ray diffraction.

Specifically, although FIG. 4 shows the X-ray diffraction result on Example 1, similar results were obtained for the other Examples 2 to 7. Thus, it was confirmed that the zirconium-based metallic glass components 4 were maintained to be amorphous.

As is clear from Table 1, in Examples 1 to 7, it was possible to produce various kinds of interference colors, such as green, blue, yellow, gray, light brown and black by carrying out an anodizing process using an alkaline solution to form a film having a thickness of 300 nm or less on the surface of the zirconium-based metallic glass component 4. Thus, it was possible to realize a wide variety of colors to be produced on the surface of the zirconium-based metallic glass component 4 without causing crystallization of zirconium-based metallic glass.

On the other hand, in any of Comparative Examples 1 to 4, it was not possible to confirm coloring of the surface of the zirconium-based metallic glass component 4.

Table 2 shows observation results and measurement results on interference films on zirconium-based metallic glass components 4 in the cases of Examples 8 to 14 and Comparative Examples 5 to 7.

The interference films on the zirconium-based metallic glass components 4 were formed by use of the method of coloring a surface of a zirconium-based metallic glass component according to the second embodiment described above.

The interference films on the zirconium-based metallic glass components 4 were formed in the following manner. Specifically, in the heating apparatus 10 shown in FIG. 2, a zirconium-based metallic glass component 4 having a length of 20 mm, a width of 20 mm and a thickness of 0.5 mm was fixed in the center of the tubular vessel 11 having an inside diameter of 100 mm. Thereafter, the zirconium-based metallic glass component 4 was heated by the electric heater 12 provided around the tubular vessel 11.

In this heating, an oxygen-free atmosphere was set by allowing the inert gas G to pass through the tubular vessel 11 from the inlet 11*a* toward the outlet 11*b*. Thereafter, the vessel ventilated by switching to inert gas G prepared to contain 300 ppm of oxygen.

After the ventilation for a sufficient amount of time with the prepared inert gas G, heating was performed for an appropriate amount of time while maintaining an appropriate temperature.

Table 2 shows "type of the inert gas G," "oxygen concentration in the inert gas G," "flow rate of the inert gas G," "heating temperature" and "processing time," all of which were used here.

Note that it was previously confirmed that a crystallization temperature of the zirconium-based metallic glass used here was 483° C.

formed at the heating temperature of 500° C. in the inert gas atmosphere having the oxygen concentration of 300 ppm.

Furthermore, the interference film on the zirconium-based metallic glass component 4 according to Comparative Example 7 was formed in a case where heating was performed at the heating temperature of 400° C. in the normal atmosphere.

Moreover, Table 2 also shows "film color," "color evenness," "film thickness" and "confirmation of whether component is maintained to be amorphous," which are observation results and measurement results on the zirconium-based metallic glass components 4 obtained under the respective processing conditions (electrochemical conditions).

"Film color" and "color evenness" are the observation results obtained with the naked eye, and "film thickness" is the measurement result obtained by XPS (X-ray photoelectron spectroscopy). Moreover, as to "confirmation of whether component is maintained to be amorphous," as a result of checking a structure of the surface layer of the metallic glass component by X-ray diffraction, as according to the first embodiment, the same result as that shown in FIG. 4 was obtained for those of Examples 8 to 14, and the component itself was maintained to be amorphous.

Note that, in Table 2, "O" means "even" and "X" means "uneven" under "color evenness." Moreover, "O" means "maintained to be amorphous" and "X" means "not maintained to be amorphous" under "confirmation of whether component is maintained to be amorphous."

As is clear from Table 2, in Examples 8 to 14, it was possible to evenly produce various kinds of interference colors, such as blue, purple, gold, yellow, black, brown and gray by heating the zirconium-based metallic glass component at the crystallization temperature of zirconium-based metallic

TABLE 2

| | Gas | Oxygen concentration (ppm) | Flow rate (L/min) | Temperature (° C.) | Processing time (minute) | Color evenness | Film color | Film thickness (nm) | Confirmation of whether component is maintained to be amorphous |
|---|---|---|---|---|---|---|---|---|---|
| Example 8 | Ar | 300 | 2 | 400 | 10 | ○ | Blue | 120 | ○ |
| Example 9 | Ar | 480 | 1 | 445 | 10 | ○ | Purple | 140 | ○ |
| Example 10 | Ar | 100 | 2 | 420 | 8 | ○ | Gold | 140 | ○ |
| Example 11 | Ar | 80 | 2 | 450 | 1 | ○ | Yellow | 180 | ○ |
| Example 12 | N2 | 100 | 1 | 400 | 15 | ○ | Black | 280 | ○ |
| Example 13 | N2 | 150 | 1 | 420 | 10 | ○ | Brown | 150 | ○ |
| Example 14 | Ar | 300 | 1 | 400 | 10 | ○ | Gray | 80 | ○ |
| Comparative Example 5 | Ar | 540 | 1 | 440 | 10 | X | Purple | 120 | ○ |
| Comparative Example 6 | Ar | 300 | 2 | 500 | 5 | X | Blue | 180 | X |
| Comparative Example 7 | Atmosphere | — | — | 400 | 15 | X | Black | Not evaluated | X |

As shown in Table 2, the interference films on the zirconium-based metallic glass components 4 in the cases of Examples 8 to 14 were formed in a case where heating was performed at the heating temperature of 483° C. or less in the inert gas atmosphere having the oxygen concentration of 500 ppm or less.

Meanwhile, the interference film on the zirconium-based metallic glass component 4 according to Comparative Example 5 was formed in a case where heating was performed at the heating temperature of 440° C. in the inert gas atmosphere having the oxygen concentration of 540 ppm.

Moreover, the interference film on the zirconium-based metallic glass component 4 according to Comparative Example 6 was formed in a case where heating was perglass or less in the inert gas having the oxygen concentration of 500 ppm or less to form a film producing the interference colors with a thickness of 300 nm or less on the surface of the zirconium-based metallic glass component 4. Thus, it was possible to realize a wide variety of colors to be produced on the surface of the zirconium-based metallic glass component without causing crystallization of the zirconium-based metallic glass.

On the other hand, in all of Comparative Examples 5 to 7, the surface of the zirconium-based metallic glass component was only colored in very limited interference colors including blue, purple and black. Moreover, the surface was unevenly colored. Furthermore, in Comparative Examples 6 and 7, the zirconium-based metallic glass was crystallized to lower strength of the zirconium-based metallic glass component.

INDUSTRIAL APPLICABILITY

As described above, according to the present invention, it is possible to provide a method of coloring a surface of a zirconium-based metallic glass component, the method makes it possible to realize a wide variety of colors to be produced on the surface of the zirconium-based metallic glass component (a component to be formed) without causing crystallization on the surface.

What is claimed:

1. A method of coloring a surface of a zirconium-based metallic glass component, comprising the step of;

imparting an interference color selected from gray, blue, purple, gold, yellow, brown and black by forming a film having a thickness of 80 nm or more and 300 nm or less on the surface of the zirconium-based metallic glass component, by heating the zirconium-based metallic glass component at a temperature of 400° C. or more and 450° C. or less for a time period of 1 to 15 minutes, the temperature being equal to or lower than a crystallization temperature of zirconium-based metallic glass in an inert gas atmosphere having an oxygen concentration of 80 ppm or more and 500 ppm or less, wherein the gray color is formed by heating in an argon gas atmosphere having an oxygen concentration of about 300 ppm and a flow rate of about 1 L/min, the blue color is formed by heating in an argon gas atmosphere having an oxygen concentration of about 300 ppm and a flow rate of about 2 L/min, the purple color is formed by heating in an argon gas atmosphere having an oxygen concentration of about 480 ppm and a flow rate of about 1 L/min, the gold color is formed by heating in an argon as atmosphere having an oxygen concentration of about 100 ppm and a flow rate of about 2 L/min, the yellow color is formed by heating in an argon gas atmosphere having an oxygen concentration of about 80 ppm and a flow rate of about 2 L/min, the brown color is formed by heating in a nitrogen gas atmosphere having an oxygen concentration of about 150 ppm and a flow rate of about 1 L/min, and the black color is formed by heating in a nitrogen gas atmosphere having an oxygen concentration of about 100 ppm and a flow rate of about 1 L/min.

* * * * *